US005649335A

United States Patent [19]

Tye

[11] Patent Number: 5,649,335

[45] Date of Patent: Jul. 22, 1997

[54] AUTOMATIC BOTTLE SCRUBBER

[75] Inventor: David Tye, Huntington Beach, Calif.

[73] Assignee: Universal Aqua Technologies, Inc., Sante Fe Springs, Calif.

[21] Appl. No.: 551,837

[22] Filed: Nov. 7, 1995

[51] Int. Cl.[6] ..... A47L 15/39; B08B 9/36

[52] U.S. Cl. ..... 15/60

[58] Field of Search ..... 15/59–64, 101

[56] References Cited

U.S. PATENT DOCUMENTS

| | | | |
|---|---|---|---|
| 575,046 | 1/1897 | Tunelius | 15/63 |
| 762,522 | 6/1904 | Gillessen | 15/61 |
| 768,492 | 8/1904 | Tuelins | 15/63 |
| 827,388 | 7/1906 | Paul | 15/63 |
| 1,053,903 | 2/1913 | Chilton | 15/60 |
| 1,110,817 | 9/1914 | Pinkney | 15/60 |

FOREIGN PATENT DOCUMENTS

| | | | |
|---|---|---|---|
| 363499 | 12/1931 | United Kingdom | 15/63 |

OTHER PUBLICATIONS

Prior art bottle washers from D & L Manufacturing Company, Inc., Menomonee Falls, Wisconsin, advertisement publication date "Spring, 1995".

Prior art bottle washers from Cap Snap Co., San Jose, California, advertisement publication date "Spring, 1995".

Prior art bottle washers from Viking Water Systems, Inc., Tustin, California, advertisement publication date "Spring, 1995".

*Primary Examiner*—Mark Spisich

*Attorney, Agent, or Firm*—D'Alessandro & Ritchie

[57] ABSTRACT

An automatic bottle scrubber for use with automatic bottle washing machines utilizes vertical powered brushes which rotate as the bottles go by on a conveyor system to scrub the bottles in a wet environment to remove dirt. The bottles are allowed to rotate during the scrubbing process so that all of the exterior of the bottle will be scrubbed. The brushes used are preferably helically disposed on a drive rod and rotated in such a manner as to cause the bottle to lift up out of its conveyor receptacle. Thus, while rotating, abrasion to the bottle and to the conveyor receptacle is minimized due to reduced contact between the conveyor receptacle and the bottle. A guide or bar disposed over the scrubber station keeps the bottles from coming completely out of the conveyor receptacle.

11 Claims, 5 Drawing Sheets

AUTOMATIC BOTTLE SCRUBBER

BACKGROUND OF THE INVENTION

1. Field of the Invention

The present invention is directed to a mechanism for scrubbing bottles prior to use. More particularly, the present invention is directed to a mechanism for scrubbing the outside of polycarbonate water bottles having a circular cross section while inverted without imparting extensive abrasion to the necks of the bottles.

2. The Prior Art

Cylindrically-shaped five gallon/19 liter water bottles are ubiquitous throughout the world. These bottles have a cylindrical body with a narrow tapered neck and an opening at the top of the neck. They are found in virtually every office building. In the past, these bottles were made of heavy glass and were recycled by use of glass bottle cleaning technology. Glass bottles have in essence completely disappeared from the market having been replaced by lighter and far less breakable polycarbonate bottles. Such bottles are typically used by a customer, emptied, stored somewhere for awhile, and then picked up for re-use by a delivery person who brings new, full bottles for use by the customer. During the storage and transportation phases of this process there is ample opportunity for the bottles to become covered with dirt. Dirty bottles must be cleaned before re-use.

There are a number of bottle washer devices presently available in the marketplace. The purpose of these devices is primarily directed at cleaning the inside of the bottle to make it clean for the receipt of drinking water. Typically these devices take an input stream on a conveyor belt of 5 gallon/19 liter cylindrically shaped water bottles, some of which may be quite dirty, clean the insides of the bottles, fill the bottles with drinking water, and cap them. Examples of these bottle washer/fillers are the Econo Plant, MiniPlant and Double End Washers from D & L Manufacturing Company, Inc. of Menomonee Falls, Wis., various washing, filling and capping systems from Cap Snap Co. of San Jose, Calif., and the VK-375 full service filling station from Viking Water Systems, Inc. of Tustin, Calif. These prior art systems all provide washing sprays to attempt to clean the bottles. Caked on dirt which is not significantly removed by the sprays must be removed either before or after filling in a manual process, such as by having employees hand scrub the dirtiest bottles. This manual process is undesirable because it adds cost and unpredictability to the process.

SUMMARY OF THE INVENTION

The present invention is directed to an automatic bottle scrubber for use with automatic bottle washing machines. According to a first aspect of the invention, vertical powered brushes at a scrubber station rotate as the bottles go by on a conveyor system to scrub the bottles in a wet environment to remove dirt. According to a second aspect of the invention, the bottles are allowed to rotate during the scrubbing process so that all of the exterior of the bottle will be scrubbed. According to a third aspect of the invention, the brushes used are helically disposed on a drive rod ("helical brushes") and rotated in such a manner as to cause the bottle, when in contact with the rotating helical brush(es), to lift up partially out of its conveyor receptacle. Thus, while rotating, abrasion to the bottle and to the conveyor receptacle is minimized due to reduced contact between the conveyor receptacle and the bottle. A guide or bar disposed over the scrubber station keeps the bottles from coming completely out of the conveyor receptacles.

OBJECTS AND ADVANTAGES OF THE INVENTION

Accordingly, it is an object of the present invention to provide a mechanism for automatically cleaning the outside surface of cylindrically-shaped water bottles as part of the conventional cleaning process.

It is a further object of the present invention to provide a mechanism to cause the bottles to rotate during the automatic scrubbing process.

Yet a further object of the present invention is to cause the bottles, while rotating, to lift slightly up and out of contact with the conveyor receptacle which carries the bottle through the automatic washing system so as to prevent or reduce scratches caused by friction between the conveyor receptacle and the bottle.

These and many other objects and advantages of the present invention will become apparent to those of ordinary skill in the art from a consideration of the drawings and ensuing description of the invention.

DESCRIPTION OF THE PREFERRED EMBODIMENTS

Those of ordinary skill in the art will realize that the following description of the present invention is illustrative only and is not intended to be in any way limiting. Other embodiments of the invention will readily suggest themselves to such skilled persons from an examination of the within disclosure.

Figure 1:
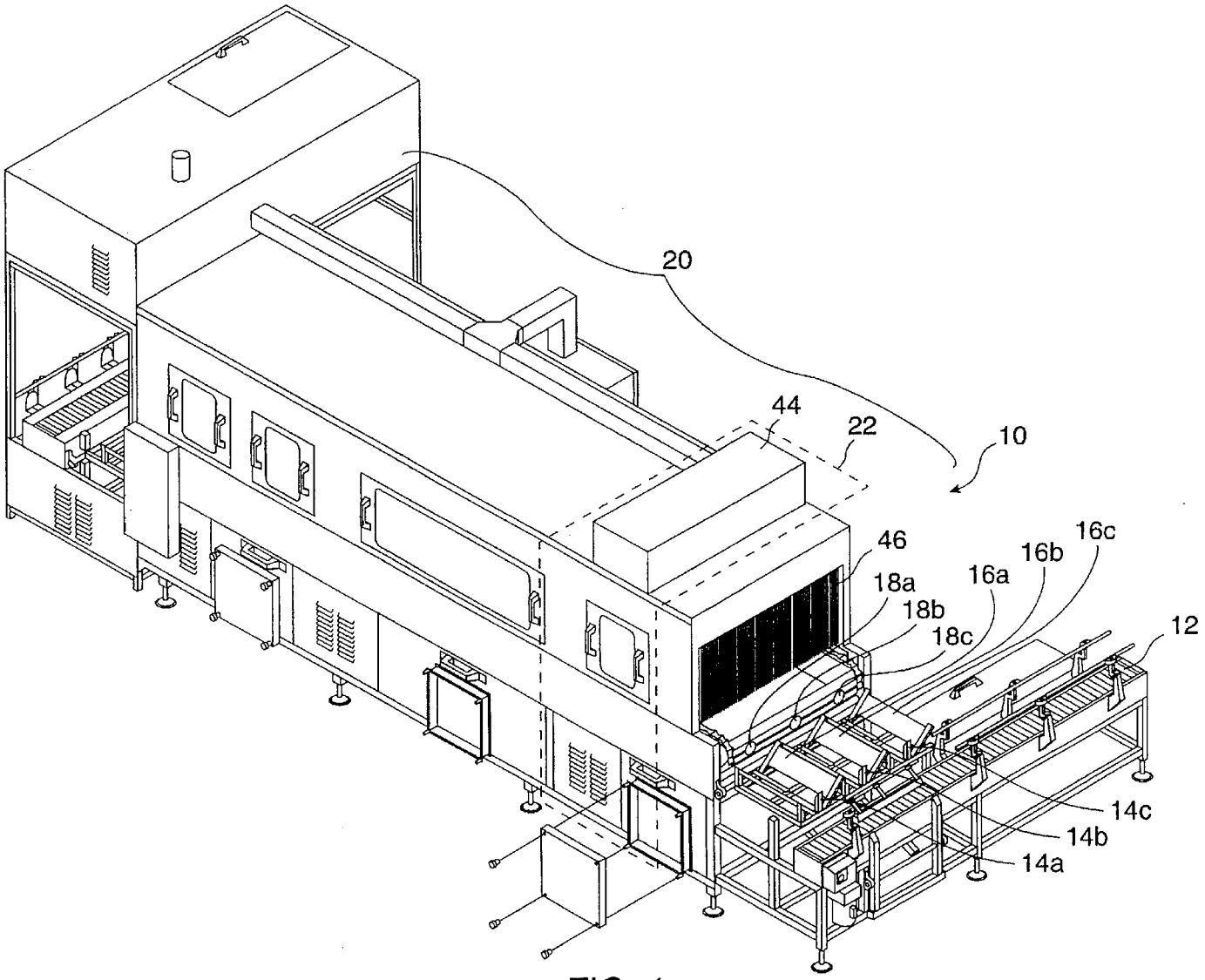
FIG. 1 is a perspective drawing of a bottle washing, filling and capping system including the scrubbing system according to the present invention.
Figure 2:
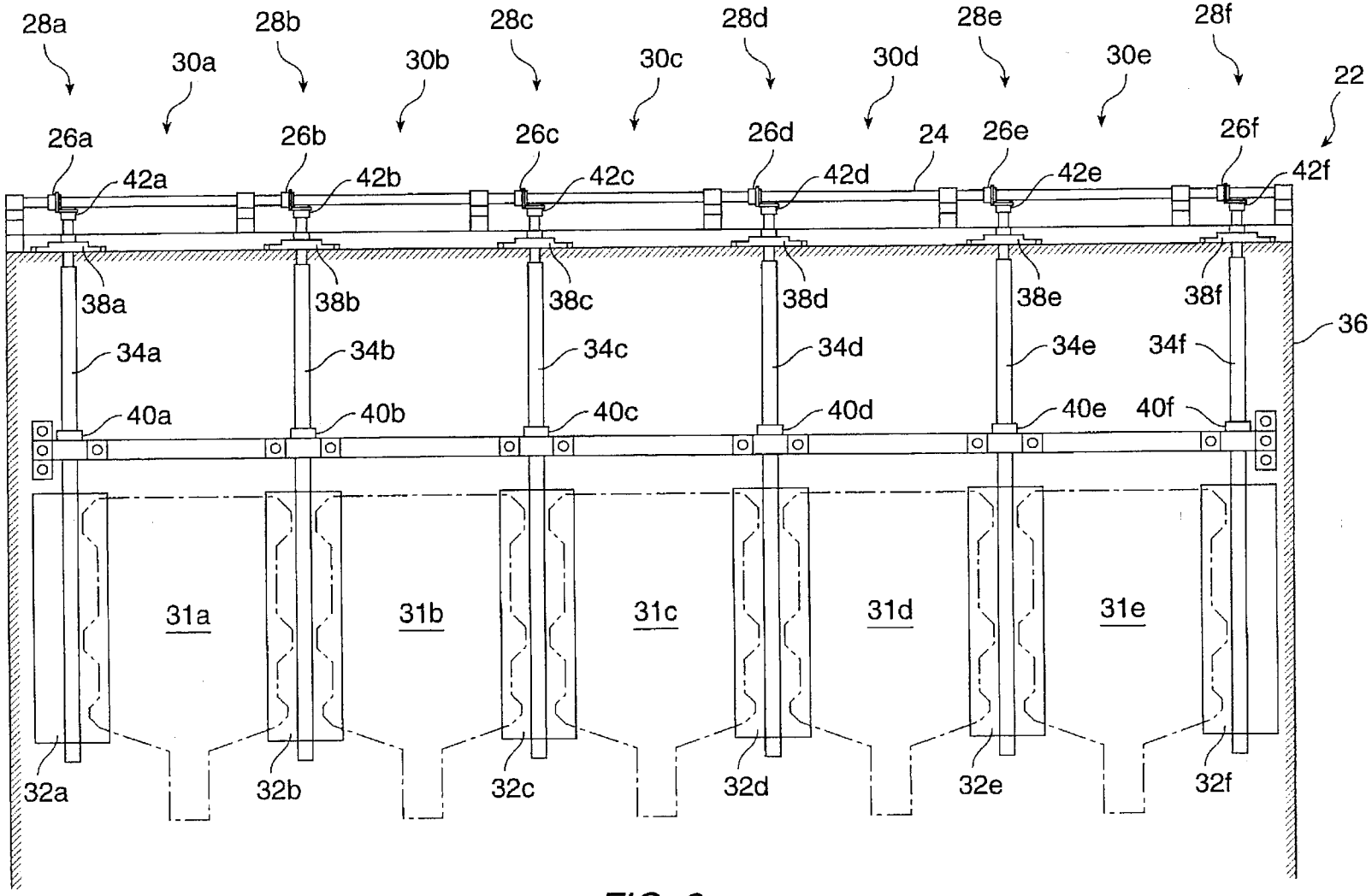
FIG. 2 is an elevational drawing of the scrubbing system according to a presently preferred embodiment of the present invention.

Turning now to FIG. 1, a bottle washing, filling and capping system incorporating a bottle scrubber is shown generally at 10. An first input conveyor 12 delivers bottles to a plurality of parallel processing tracks 14*a*, 14*b*, 14*c*. The bottles travel on conveyor 12 in a vertical, opening-on-top configuration. When they arrive at cradles 16*a*, 16*b* and 16*c* which correspond with parallel tracks 14*a*, 14*b* and 14*c*, they are automatically knocked over so that the openings of the bottles face conveyor receptacles 18*a*, 18*b*, and 18*c*, respectively. A conventional mechanism then automatically pushes the bottles into the conveyor receptacles (collectively referred to as 18) while a second conveyor mechanism moves the bottles to the vertical, opening-on-bottom configuration for travel through the cleaning portion 20 of apparatus 10. The scrubbing process occurs at scrubbing station 22 which is preferably the first station in the process. All of the washing and scrubbing process is accompanied by the spraying of water onto and into the bottles and thus takes place in a wet environment within apparatus 10. Turning now to FIG. 2, scrubbing station 22 is depicted in more detail. It should be noted that the scrubbing station 22 of FIG. 2 shows five parallel tracks of bottle processing while the device 10 of FIG. 1 is adapted for only three parallel tracks of bottle processing. The number of parallel tracks determines throughput capacity and is determined at the time the device 10 is fabricated. In FIG. 2 a drive rod 24 is powered by a motor (not shown) preferably linked to drive rod 24 with either a gear configuration or a drive belt and pulley configuration (not shown) as well known to those of ordinary skill in the art. Drive rod 24 has a 45° gear 26*a*–26*f* (again, collectively referred to herein as 26—this convention will be used throughout this disclosure) at each scrub brush location 28*a*–28*f*. A pair of scrub brushes 32*a*–32*f* straddles each bottle scrubbing position 30*a*–30*e* as shown (i.e., 32*a* and 32*b* are on either side of bottle scrubbing position 30*a*). Bottles in scrubbing positions 30*a*–30*e* are shown in phantom lines at 31*a*–31*e*. Each scrub brush is coupled to a rod 34*a*–34*f* which is held to a framework 36 by upper bearings 38*a*–38*f* and lower bearings 40*a*–40*f*. Each rod 34*a*–34*f* has at its top end a 45° gear 42*a*–42*f* which mates with gear 26*a*–26*f*, respectively. Referring to FIG. 1, the drive mechanism for the brushes is housed in a box 44 above the tunnel 46 through which the bottles move.

Figure 3:
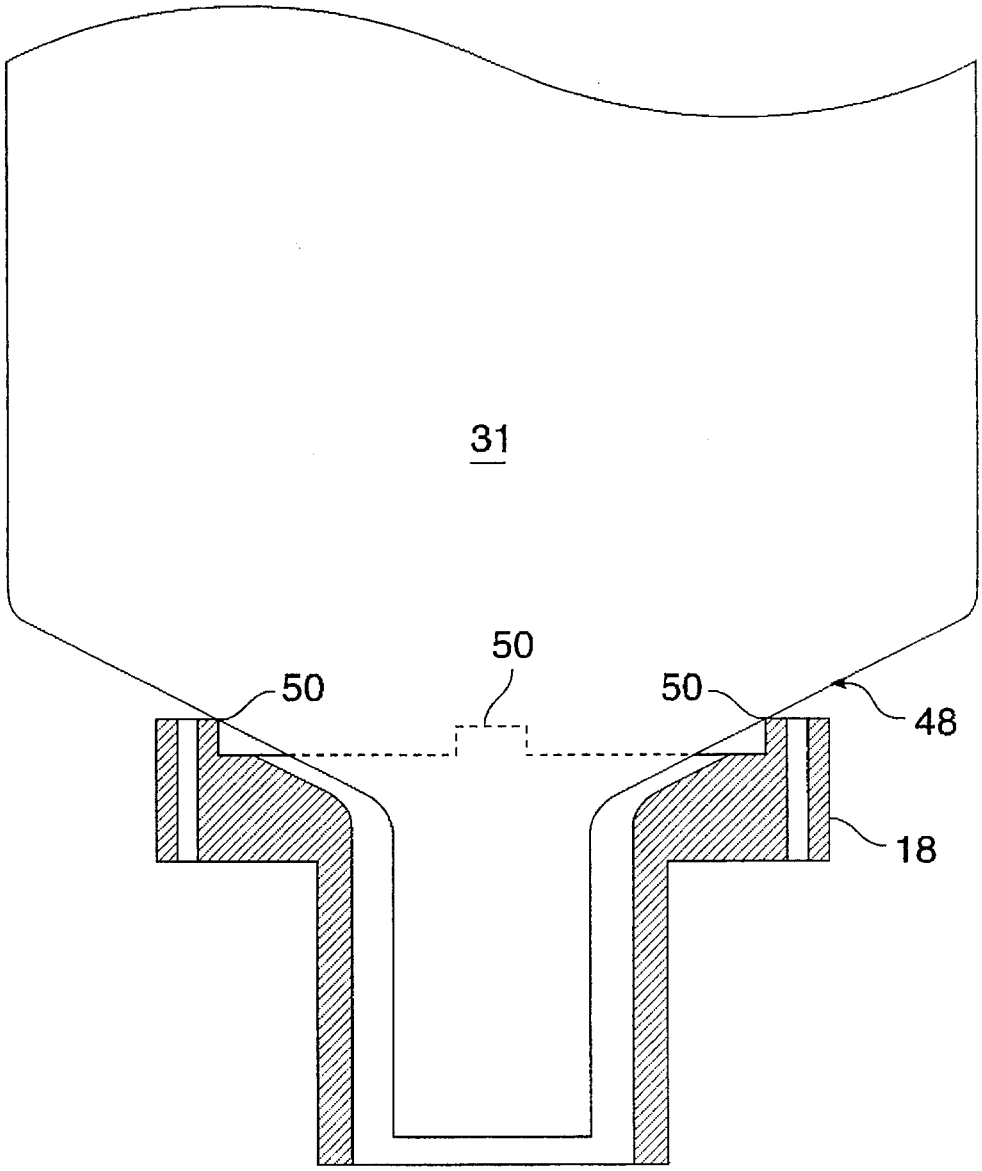
FIG. 3 is a diagram showing a bottle seated in a conveyor receptacle.
Figure 4:
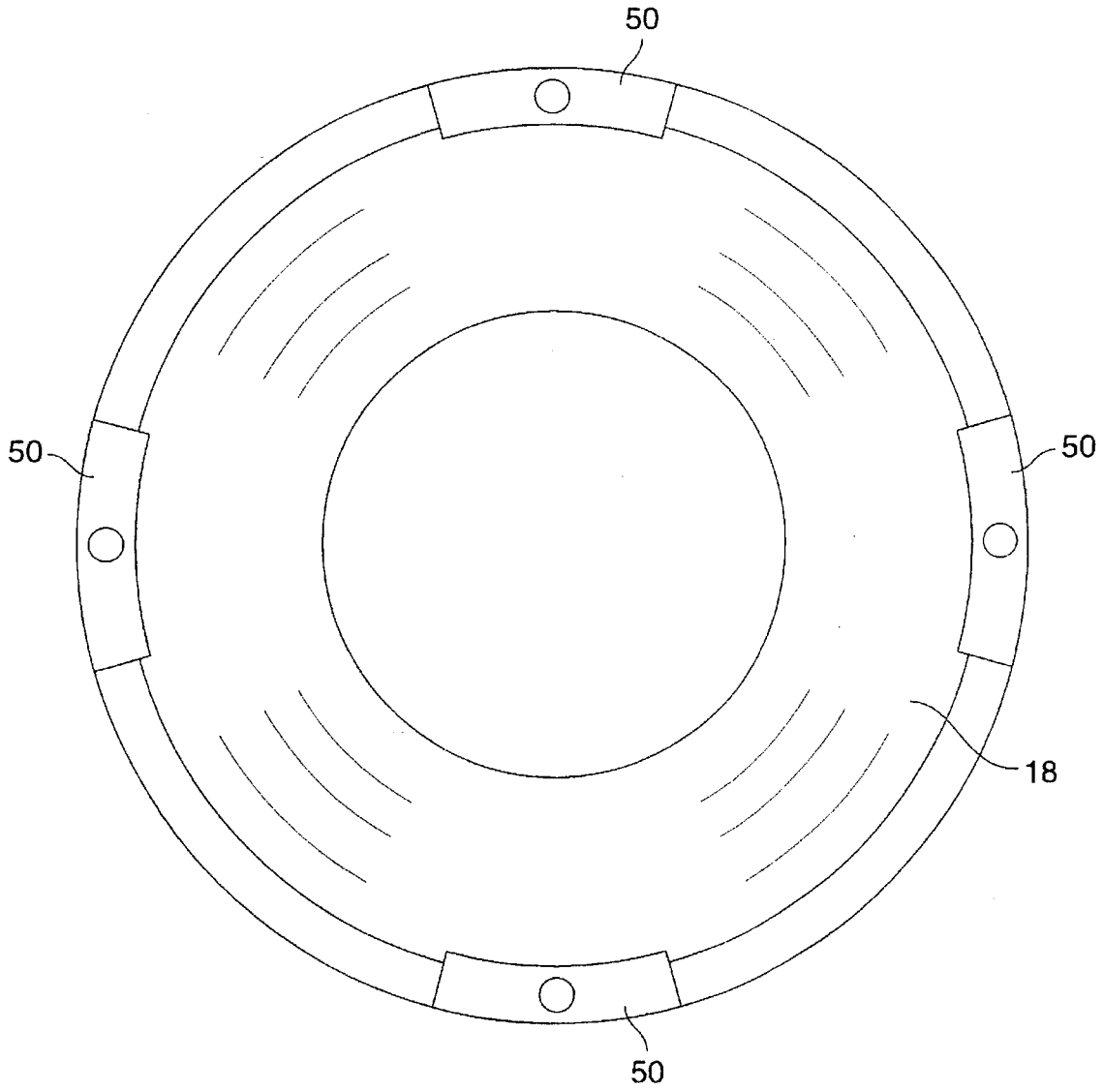
FIG. 4 is a top plan view of the conveyor receptacle.

In order to achieve scrubbing over the entire outer cylindrical surface of the bottles 31*a*–31*e*, the bottles must rotate while brushes 32*a*–32*f* are operating. This is generally not a problem as the brushes, because they rotate themselves, will impart rotary drive motion to the bottles causing them to rotate. As shown in FIG. 3, the bottles 31 are seated in a central orifice of a conveyer receptacle 18 in a vertical, opening-on-bottom configuration for travel through the washing portion 20 of device 10. The conveyor receptacle shown also in FIG. 4, is formed of HDMP (high density molecular polyethylene) and, while not an extremely hard material, is designed to last for a high number of cycles. If the polycarbonate bottles were permitted to spin freely in full contact with the conveyor receptacles, it would be likely that unsightly abrasions at the neck 48 of the bottles 31 would appear due to abrasive wear between the necks 48 of bottles 31 and the seat 50 of the conveyor receptacle 18. As such abrasions are considered undesirable from an aesthetic point of view, it is therefore desirable to provide the advantages discussed above without causing such abrasions.

Figure 5:
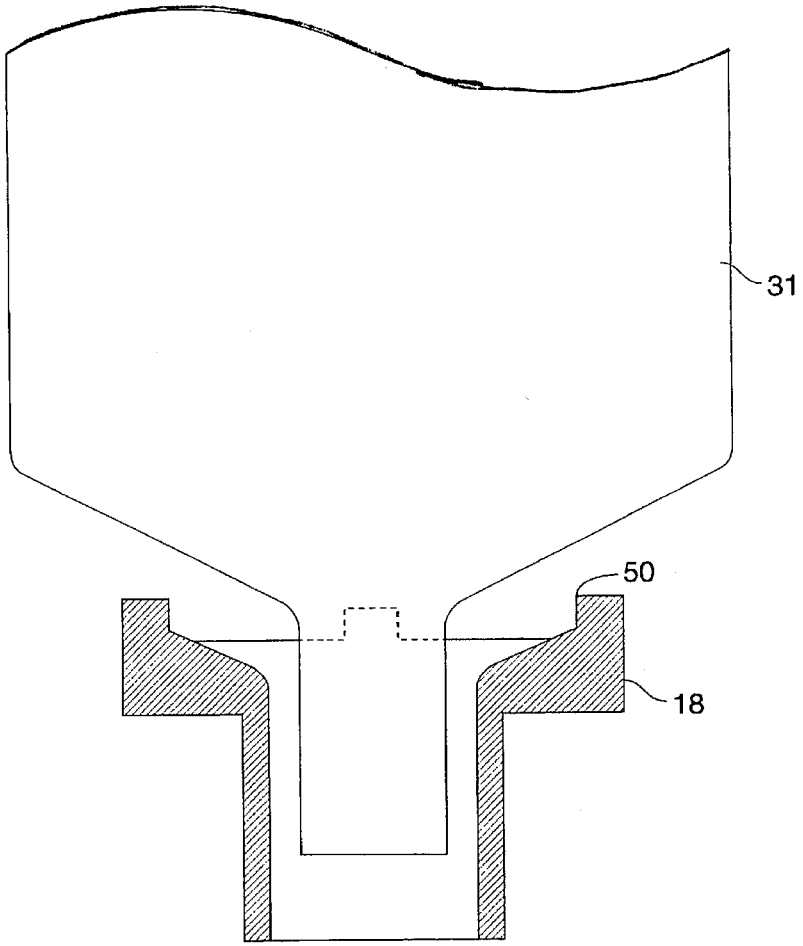
FIG. 5 is a diagram showing the bottle slightly elevated out of contact with the receptacle as it might be during the scrubbing process in accordance with a presently preferred embodiment of the present invention.
Figure 6:
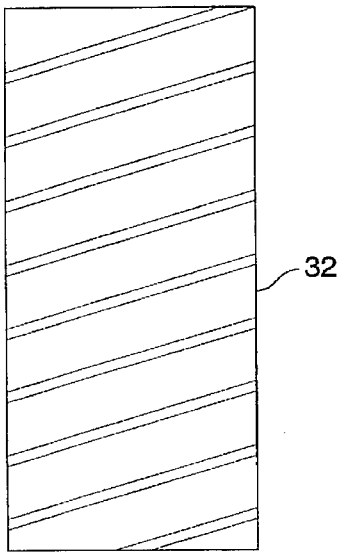
FIG. 6 is a diagram of a brush used in accordance with a preferred embodiment of the present invention to help lift the bottle and reduce abrasion between the bottle and the conveyor receptacle during scrubbing.

The abrasion problem is solved as shown in FIGS. 5 and 6. Brushes 32*a*–32*f* are preferably formed in a spiral or helix. When they turn, they impart a screw-like (upward or downward) impetus to bottles 31. By orienting the brushes so that the screw-like impetus causes the bottles to rise with respect to conveyor receptacle 18 as shown in FIG. 5, contact between the bottles 31 and the conveyor receptacles 18 during the rotational movement of the bottles caused by the rotation of brushes 32 is minimized. This minimizes abrasive wear both of the bottles 31 and the conveyor receptacles 18. Part of frame 36 (FIG. 2) or a guide bar or another element may preferably be used to prevent the bottles from being lifted enough so that they become disengaged from their respective conveyor receptacles and become loose in the washer apparatus 10. According to a presently preferred embodiment of the present invention, the brushes used are designated model no. U.A.T. No. 0.010CR and are available from J. E. K., Inc. of 6626 Merchandise Way, Diamond Springs, Calif. 95919. The brushes are fabricated of Nylon. The helix pitch angle of the brushes is 15 degrees above the circumference. They are preferably spun at a rate of about 100 R.P.M. for conventional ½ pound (empty) bottles.

While illustrative embodiments and applications of this invention have been shown and described, it would be apparent to those skilled in the art that many more modifications than have been mentioned above are possible without departing from the inventive concepts set forth herein. The invention, therefore, is not to be limited except in the spirit of the appended claims.

What is claimed is:

1. A bottle washing system for washing bottles having a cylindrical body and a narrow tapered neck, said system comprising:

means for conveying each of the bottles to a bottle scrubbing position of a bottle scrubbing station of the system, each of the bottles being oriented in a vertical, opening-on-bottom configuration, each said opening being disposed in a central orifice of a respective conveyor receptacle;

a plurality of cylindrical brushes, at least a pair of which are disposed about each said bottle scrubbing position and adapted to contact a respective one of the bottles disposed at said bottle scrubbing position, at least one of said pair of brushes having brush bristles disposed in a helical pattern; and means for providing rotary motion to said brushes, said rotary motion causing a respective one of the bottles disposed at said bottle scrubbing position to lift up and away from said respective conveyor receptacle.

2. A bottle washing system according to claim 1, wherein:

said brushes about each said bottle scrubbing position engage said respective one of the bottles and cause it to rotate.

3. A bottle washing system for washing bottles having a cylindrical body and a narrow tapered neck, said system comprising:

means for conveying each of the bottles to a bottle scrubbing position of a bottle scrubbing station of the system, the bottles each being oriented in a vertical, opening-on-bottom configuration, each said opening being disposed in a central orifice of a respective conveyor receptacle;

a plurality of cylindrical brushes, at least a pair of which are disposed about each said bottle scrubbing position;

means for providing rotary motion to said brushes wherein said brushes about each bottle scrubbing position engage a respective one of the bottles and cause it to rotate;

wherein at least one of said cylindrical brushes about each bottle scrubbing position is a helical brush which, when rotated in contact with a respective one of the bottles disposed within said central orifice of the conveyor receptacle of the respective bottle scrubbing position, imparts an upward impetus to the respective one of the bottles lifting it up away from the conveyor receptacle of the respective bottle scrubbing position.

4. A bottle washing system according to claim 3, further comprising:

means disposed above each said bottle scrubbing position for limiting upward movement of the respective one of the bottles and retaining the respective one of the bottles at least partially within the conveyor receptacle of the respective bottle scrubbing position.

5. A bottle washing system for washing bottles having a cylindrical body and a narrow tapered neck, said system comprising:

conveyor means for conveying at least two parallel tracks of bottles through the system, said conveyor means adapted to convey each of the bottles to a bottle scrubbing position of a bottle scrubbing station of the system, the bottles being oriented in a vertical, opening-on-bottom configuration at said scrubbing position, each said opening being disposed in a central orifice of a respective conveyor receptacle;

a plurality of vertically disposed helically patterned cylindrical brushes provided with a rotary drive means so that each of said brushes may rotate about a vertical axis, at least a pair of said brushes being disposed about each said bottle scrubbing position, said brushes about each said bottle scrubbing position being oriented so as to contact and drive a respective one of the bottles in said bottle scrubbing position into rotary motion about a vertical axis, rotation of said brushes causing a respective one of the bottles disposed at said bottle scrubbing position to lift. up and away from said respective conveyor receptacle.

6. A bottle washing system for washing bottles having a cylindrical body and a narrow tapered neck, said system comprising:

conveyor means for conveying at least two tracks of bottles through the system, said conveyor means adapted to convey each of the bottles to one of a plurality of bottle scrubbing positions of a bottle scrubbing station of the system, each of the bottles being oriented in a vertical, opening-on-bottom configuration at said scrubbing position, each said opening being disposed in a central orifice of a respective conveyor receptacle;

a plurality of vertically disposed cylindrical brushes provided with a rotary drive means so that said brushes may rotate about a vertical axis, at least a pair of said brushes being disposed about each said bottle scrubbing position, said brushes about each said bottle scrubbing position being oriented to contact and drive a respective one of the bottles in said respective bottle scrubbing position into rotary motion about a vertical axis, at least one of said brushes being a helical brush which, when rotated in contact with a respective one of the bottles disposed within said central orifice of said respective conveyor receptacle, imparts an upward impetus to the respective bottle lifting it up and away from said respective conveyor receptacle.

7. A bottle washing system according to claim 6, further comprising:

means disposed above each said bottle scrubbing position for limiting upward movement of the respective one of the bottles and retaining the respective one of the bottles at least partially within said respective conveyor receptacle.

8. A bottle washing system for washing plastic bottles having a cylindrical body, a sealed bottom and an opening at a narrow tapered neck, said system comprising:

a conveyor for moving bottles through the system, said conveyor including a plurality of conveyor receptacles, each conveyor receptacle having a central orifice;

a bottle scrubbing position of a bottle scrubbing station for receiving and scrubbing each of the bottles, each of the bottles being received by said bottle scrubbing position oriented in a vertical, opening-on-bottom configuration, the narrow tapered necks of each of the bottles being disposed in a respective one of said central orifices;

a plurality of cylindrical brushes coupled to a source of rotary power, at least a pair of which are disposed about said bottle scrubbing position and adapted to sequentially engage each of the bottles and cause rotary motion thereof, at least one of said brushes being a helical brush which, when rotated in contact with a respective bottle disposed within said central orifice, imparts an upward impetus to the respective bottle lifting it up and away from said conveyor receptacle.

9. A bottle washing system according to claim 8, further comprising:

means disposed above each said bottle scrubbing position for limiting upward movement of the respective bottle and retaining the respective bottle at least partially within said respective one of said central orifices of said respective conveyor receptacle.

10. A bottle washing system for washing bottles, each of the bottles having a necked portion with an opening therein, said system comprising:

a conveyor having a plurality of conveyor receptacles, each conveyor receptacle adapted to receive the necked portion of a respective bottle in an opening-on-bottom configuration, said conveyor adapted to serially convey the bottles to a bottle scrubbing position of the system;

said bottle scrubbing position equipped with a helically patterned cylindrical brush adapted to rotate and engage a respective bottle held by a respective conveyor receptacle at said bottle scrubbing position, said brush imparting an upward impetus to the respective bottle while said brush is rotating, said upward impetus causing the respective bottle to move upward and away from said respective conveyor receptacle.

11. A bottle washing system according to claim 10, further comprising:

means disposed above said bottle scrubbing position for limiting upward movement of the respective bottle and retaining the respective bottle at least partially within said respective conveyor receptacle.

* * * * *